US005980305A

United States Patent [19]

Bratten et al.

[11] Patent Number: 5,980,305

[45] Date of Patent: Nov. 9, 1999

[54] WIRING SPLICE JUNCTION BLOCK

[76] Inventors: Larry R. Bratten; Mary A. Bratten, both of 118 Oak Leaf Dr., La Vernia, Tex. 78121

[21] Appl. No.: 09/001,434

[22] Filed: Dec. 31, 1997

[51] Int. Cl.[6] ..... H01R 4/24

[52] U.S. Cl. ..... 439/439; 439/723

[58] Field of Search ..... 439/439, 441, 439/721, 723, 724, 787, 786, 835

[56] References Cited

U.S. PATENT DOCUMENTS

| | | | |
|---|---|---|---|
| 3,585,570 | 6/1971 | Jans | 439/439 |
| 4,106,835 | 8/1978 | Kimm | 439/441 |
| 5,158,475 | 10/1992 | Tyler | 439/439 |

FOREIGN PATENT DOCUMENTS 2258156 5/1974 Germany .

*Primary Examiner*—Khiem Nguyen

[57] ABSTRACT

A new wiring splice junction block for connecting a power supply cable from a main distribution panel to two or more branch circuits. The inventive device includes a circular housing having a circular wall extending upwardly therefrom disposed inwardly with respect to its cylindrical side wall. The cylindrical side wall has a plurality of circumferentially spaced apertures therethrough. A conductive ring is secured within the circular housing. The conductive ring has a peripheral edge disposed inwardly of the circular wall of the circular housing. A plurality of resilient connectors extends radially from the peripheral edge of the conductive ring in a spaced relationship. The connectors align with the circumferentially spaced apertures of the circular housing. The connectors extend outwardly over the circular wall. A circular lid is dimensioned for covering an open upper end of the circular housing. The circular lid includes a plurality of slotted openings therethrough. The slotted openings align with the resilient connectors and the circumferentially spaced apertures.

3 Claims, 2 Drawing Sheets

WIRING SPLICE JUNCTION BLOCK

BACKGROUND OF THE INVENTION

1. Field of the Invention

The present invention relates to electrical connectors and more particularly pertains to a new wiring splice junction block for connecting a power supply cable from a main distribution panel to two or more branch circuits.

2. Description of the Prior Art

The use of electrical connectors is known in the prior art. More specifically, electrical connectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art electrical connectors include U.S. Pat. No. 5,120,244 to Saito et al.; U.S. Pat. No. 4,770,646 to Shimada; U.S. Pat. No. 5,358,424 to Bowen et al.; U.S. Pat. No. 4,217,465 to Holden; U.S. Pat. No. 4,767,352 to Pretchel; and U.S. Pat. No. Des. 323,317 to Nagasaka et al.

While these devices fulfill their respective, particular objectives and requirements, the aforementioned patents do not disclose a new wiring splice junction block. The inventive device includes a circular housing having a circular wall extending upwardly therefrom disposed inwardly with respect to its cylindrical side wall. The cylindrical side wall has a plurality of circumferentially spaced apertures therethrough. A conductive ring is secured within the circular housing. The conductive ring has a peripheral edge disposed inwardly of the circular wall of the circular housing. A plurality of resilient connectors extends radially from the peripheral edge of the conductive ring in a spaced relationship. The connectors align with the circumferentially spaced apertures of the circular housing. The connectors extend outwardly over the circular wall. A circular lid is dimensioned for covering an open upper end of the circular housing. The circular lid includes a plurality of slotted openings therethrough. The slotted openings align with the resilient connectors and the circumferentially spaced apertures.

In these respects, the wiring splice junction block according to the present invention substantially departs from the conventional concepts and designs of the prior art, and in so doing provides an apparatus primarily developed for the purpose of connecting a power supply cable from a main distribution panel to two or more branch circuits.

SUMMARY OF THE INVENTION

In view of the foregoing disadvantages inherent in the known types of electrical connectors now present in the prior art, the present invention provides a new wiring splice junction block construction wherein the same can be utilized for connecting a power supply cable from a main distribution panel to two or more branch circuits.

The general purpose of the present invention, which will be described subsequently in greater detail, is to provide a new wiring splice junction block apparatus and method which has many of the advantages of the electrical connectors mentioned heretofore and many novel features that result in a new wiring splice junction block which is not anticipated, rendered obvious, suggested, or even implied by any of the prior art electrical connectors, either alone or in any combination thereof.

To attain this, the present invention generally comprises a circular housing having an open upper end, a closed lower end and a cylindrical side wall therebetween. The closed lower end has an aperture through a central point thereof. A hollow sleeve extends upwardly from the aperture. The closed lower end has a circular wall extending upwardly therefrom disposed inwardly with respect to the cylindrical side wall. The closed lower end has a plurality of support legs extending upwardly therefrom disposed inwardly of the circular wall. The cylindrical side wall has a plurality of circumferentially spaced apertures therethrough. A conductive ring is secured to and extends around the hollow sleeve within the circular housing. The conductive ring is further supported by the plurality of support legs. The conductive ring has a peripheral edge disposed inwardly of the circular wall of the circular housing. A plurality of resilient connectors extend radially from the peripheral edge of the conductive ring in a spaced relationship. The connectors align with the circumferentially spaced apertures of the circular housing. The connectors extend outwardly over the circular wall. Each of the connectors have a downturned free end portion positioned inwardly of a corresponding circumferentially spaced aperture. A circular lid is dimensioned for covering the open upper end of the circular housing. The circular lid has a central opening for receiving an open upper end of the hollow sleeve. The circular lid includes a plurality of slotted openings therethrough. The slotted openings align with the resilient connectors and the circumferentially spaced apertures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wiring splice junction block apparatus and method which has many of the advantages of the electrical connectors mentioned heretofore and many novel features that result in a new wiring splice junction block which is not anticipated, rendered obvious, suggested, or even implied by any of the prior art electrical connectors, either alone or in any combination thereof.

It is another object of the present invention to provide a new wiring splice junction block which may be easily and efficiently manufactured and marketed.

It is a further object of the present invention to provide a new wiring splice junction block which is of a durable and reliable construction.

An even further object of the present invention is to provide a new wiring splice junction block which is susceptible of a low cost of manufacture with regard to both materials and labor, and which accordingly is then susceptible of low prices of sale to the consuming public, thereby making such wiring splice junction block economically available to the buying public.

Still yet another object of the present invention is to provide a new wiring splice junction block which provides in the apparatuses and methods of the prior art some of the advantages thereof, while simultaneously overcoming some of the disadvantages normally associated therewith.

Still another object of the present invention is to provide a new wiring splice junction block for connecting a power supply cable from a main distribution panel to two or more branch circuits.

Yet another object of the present invention is to provide a new wiring splice junction block which includes a circular housing having a circular wall extending upwardly therefrom disposed inwardly with respect to its cylindrical side wall. The cylindrical side wall has a plurality of circumferentially spaced apertures therethrough. A conductive ring is secured within the circular housing. The conductive ring has a peripheral edge disposed inwardly of the circular wall of the circular housing. A plurality of resilient connectors extends radially from the peripheral edge of the conductive ring in a spaced relationship. The connectors align with the circumferentially spaced apertures of the circular housing. The connectors extend outwardly over the circular wall. A circular lid is dimensioned for covering an open upper end of the circular housing. The circular lid includes a plurality of slotted openings therethrough. The slotted openings align with the resilient connectors and the circumferentially spaced apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
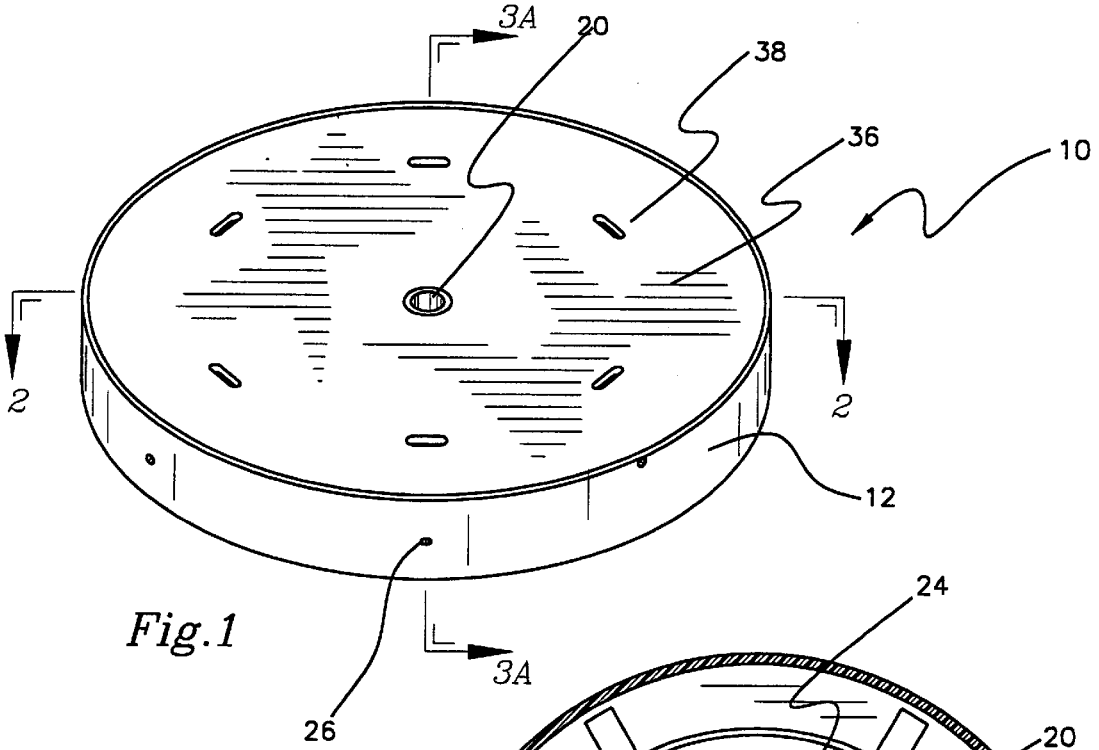
FIG. 1 is a perspective view of a new wiring splice junction block according to the present invention.
Figure 2:
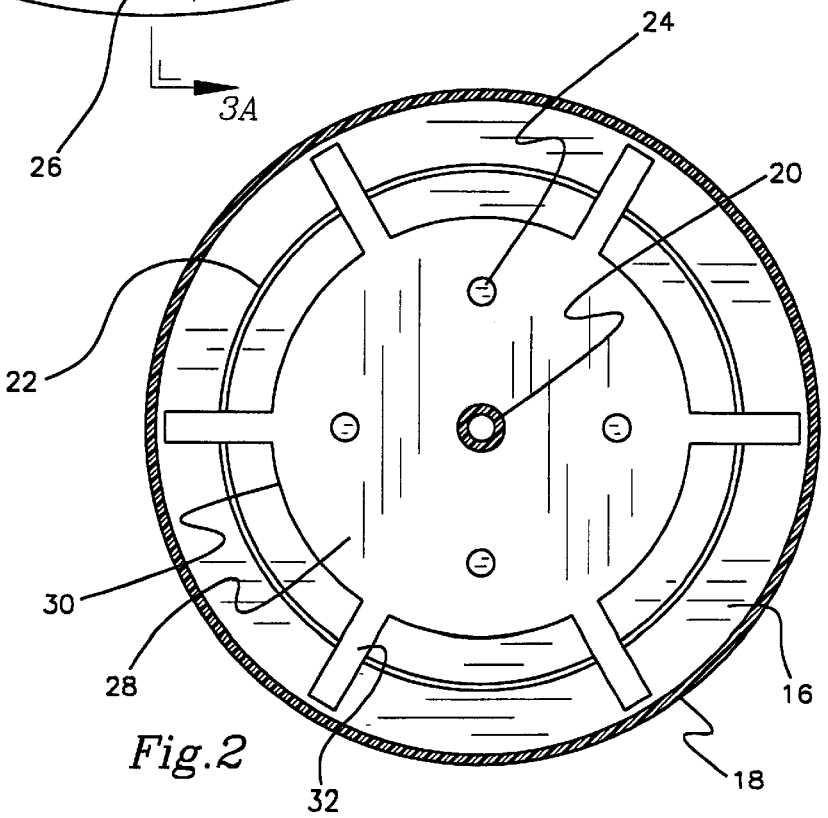
FIG. 2 is a cross-sectional of the present invention as taken along line 2—2 of FIG. 3A.
Figure 3A:
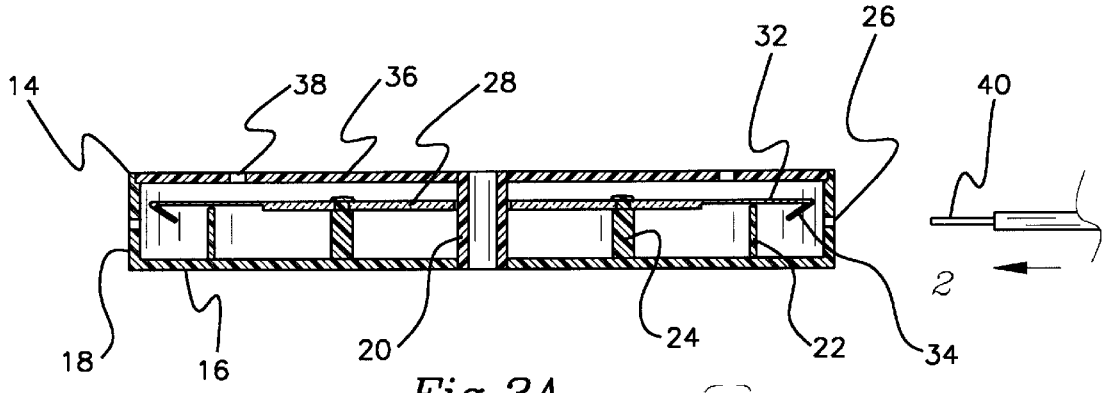
FIG. 3A is a cross-sectional view of the present invention as taken along line 3—3 of FIG. 1.
Figure 3B:
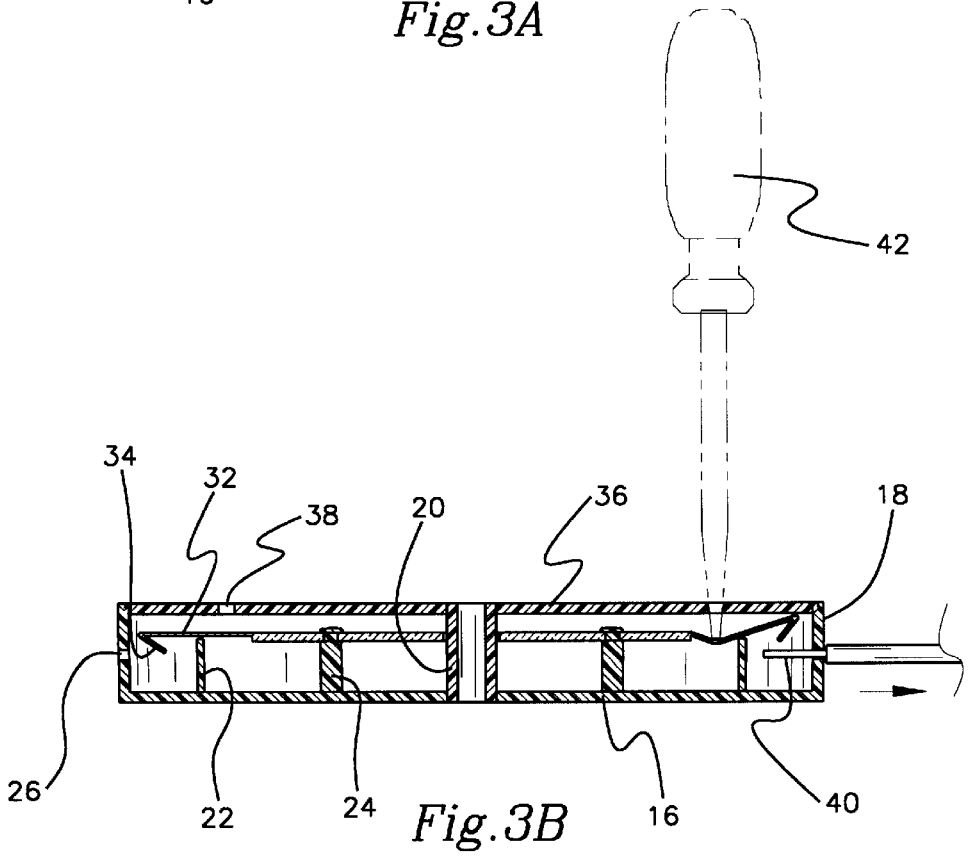
FIG. 3B is a cross-sectional view of the present invention illustrated in use.

With reference now to the drawings, and in particular to FIGS. 1 through 3 thereof, a new wiring splice junction block embodying the principles and concepts of the present invention and generally designated by the reference numeral 10 will be described.

As best illustrated in FIGS. 1 through 3, the wiring splice junction block 10 comprises a circular housing 12 having an open upper end 14, a closed lower end 16 and a cylindrical side wall 18 therebetween. The closed lower end 16 has an aperture through a central point thereof. A hollow sleeve 20 extends upwardly from the aperture. The closed lower end 16 has a circular wall 22 extending upwardly therefrom disposed inwardly with respect to the cylindrical side wall 18. The closed lower end 16 has a plurality of support legs 24 extending upwardly therefrom disposed inwardly of the circular wall 22. The cylindrical side wall 18 has a plurality of circumferentially spaced apertures 26 therethrough.

A conductive ring 28 is secured to and extends around the hollow sleeve 20 within the circular housing 12. The conductive ring 28 is further supported by the plurality of support legs 24. The conductive ring 28 has a peripheral edge 30 disposed inwardly of the circular wall 22 of the circular housing 12.

A plurality of resilient connectors 32 extend radially from the peripheral edge 30 of the conductive ring 28 in a spaced relationship. The connectors 32 align with the circumferentially spaced apertures 26 of the circular housing 12. The connectors 32 extend outwardly over the circular wall 22. Each of the connectors 32 have a downturned free end portion 34 positioned inwardly of a corresponding circumferentially spaced aperture 26.

A circular lid 36 is dimensioned for covering the open upper end 14 of the circular housing 12. The circular lid 36 has a central opening for receiving an open upper end of the hollow sleeve 20. The circular lid 36 includes a plurality of slotted openings 38 therethrough. The slotted openings 38 align with the resilient connectors 32 and the circumferentially spaced apertures 26.

In use, the device 10 would be used to connect a power supply cable from a main distribution panel to two or more branch circuits. The circumferentially spaced apertures 26 each could receive a wire 40 therein. The user would simply insert a screwdriver 42 within the slotted openings 38 in the circular lid 36 to press downwardly on the connectors 32 thereby causing the downturned end portions 34 to raise upwardly to mate with the inserted wires 40. The screwdriver 42 can then be removed allowing the downturned end portions 34 to engage the inserted wires 40. The hollow sleeve 20 allows the device 10 to be secured to a structural member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A new wiring splice junction block for connecting a power supply cable from a main distribution panel to two or more branch circuits comprising, in combination:

a circular housing having an open upper end, a closed lower end and a cylindrical side wall therebetween, the closed lower end having an aperture through a central point thereof, a hollow sleeve extending upwardly from the aperture, the closed lower end having a circular wall extending upwardly therefrom disposed inwardly with respect to the cylindrical side wall, the closed lower end having a plurality of support legs extending upwardly therefrom disposed inwardly of the circular wall, the cylindrical side wall having a plurality of circumferentially spaced apertures therethrough;

a conductive ring secured to and extending around the hollow sleeve within the circular housing, the conductive ring being further supported by the plurality of support legs, the conductive ring having a peripheral edge disposed inwardly of the circular wall of the circular housing;

a plurality of resilient connectors extending radially from the peripheral edge of the conductive ring in a spaced relationship, the connectors aligning with the circumferentially spaced apertures of the circular housing, the connectors extending outwardly over the circular wall, each of the connectors having a downturned free end portion positioned inwardly of a corresponding circumferentially spaced aperture; and a circular lid dimensioned for covering the open upper end of the circular housing, the circular lid having a central opening for receiving an open upper end of the hollow sleeve, the circular lid including a plurality of slotted openings therethrough, the slotted openings aligning with the resilient connectors and the circumferentially spaced apertures.

2. A new wiring splice junction block for connecting a power supply cable from a main distribution panel to two or more branch circuits comprising, in combination:

a circular housing having a circular wall extending upwardly therefrom disposed inwardly with respect to its cylindrical side wall, the cylindrical side wall having a plurality of circumferentially spaced apertures therethrough;

a conductive ring secured within the circular housing, the conductive ring having a peripheral edge disposed inwardly of the circular wall of the circular housing;

a plurality of resilient connectors extending radially from the peripheral edge of the conductive ring in a spaced relationship, the connectors aligning with the circumferentially spaced apertures of the circular housing, the connectors extending outwardly over the circular wall; and a circular lid dimensioned for covering an open upper end of the circular housing, the circular lid including a plurality of slotted openings therethrough, the slotted openings aligning with the resilient connectors and the circumferentially spaced apertures; and wherein a closed lower end of the circular housing has a plurality of support legs extending upwardly therefrom to further support the conductive ring.

3. The wiring splice junction box as set forth in claim 2 wherein a closed lower end of the circular housing has a circular wall extending upwardly therefrom disposed inwardly with respect to the cylindrical side wall.

* * * * *